US006939388B2

(12) United States Patent
Angeliu

(10) Patent No.: US 6,939,388 B2
(45) Date of Patent: Sep. 6, 2005

(54) METHOD FOR MAKING MATERIALS HAVING ARTIFICIALLY DISPERSED NANO-SIZE PHASES AND ARTICLES MADE THEREWITH

(75) Inventor: Thomas Martin Angeliu, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 273 days.

(21) Appl. No.: 10/064,510

(22) Filed: Jul. 23, 2002

(65) Prior Publication Data

US 2004/0016318 A1 Jan. 29, 2004

(51) Int. Cl.[7] ..... B22F 9/06

(52) U.S. Cl. ..... 75/332; 75/335; 75/560; 75/684; 75/708

(58) Field of Search ..... 75/332, 708, 414, 75/560, 684

(56) References Cited

U.S. PATENT DOCUMENTS

| | | | | |
|---|---|---|---|---|
| 3,678,988 A | | 7/1972 | Tien et al. | |
| 5,305,817 A | * | 4/1994 | Borisov et al. | 164/97 |
| 5,401,338 A | * | 3/1995 | Lin | 148/538 |
| 5,900,084 A | | 5/1999 | DeLuca et al. | |
| 6,132,532 A | | 10/2000 | Shepelev et al. | |
| 6,245,425 B1 | * | 6/2001 | McCullough et al. | 428/379 |
| 6,251,159 B1 | * | 6/2001 | Angeliu et al. | 75/414 |
| 6,730,400 B1 | * | 5/2004 | Komatsu et al. | 428/403 |
| 2003/0146529 A1 | * | 8/2003 | Chen et al. | 264/4.1 |
| 2003/0148042 A1 | * | 8/2003 | Wang | 427/601 |
| 2003/0224168 A1 | * | 12/2003 | Mack et al. | 428/408 |
| 2004/0016318 A1 | | 1/2004 | Angeliu | |

FOREIGN PATENT DOCUMENTS

EP 0 558 775 9/1993

OTHER PUBLICATIONS

O.V. Abramov, High–Intensity Ultrasonics (1998), pp. 567–568.

V.B. Kireev, O.V. Abramov, I.V. Abramov, "Effect of Ti, Y, Zr and Mg Additions on the Structure of Ingots of Dispersion–Hardened Nichrome", No. 11 (1975) pp. 35–36.

(Continued)

*Primary Examiner*—George Wyszomierski
(74) *Attorney, Agent, or Firm*—Paul J. DiConza; William E. Powell, III

(57) ABSTRACT

A method for forming a nanocomposite material and articles made with the nanocomposite material are presented. The method comprises providing a molten material; providing a nano-sized material, the nano-sized material being substantially inert with respect to the molten material; introducing the nano-sized material into the molten material; dispersing the nano-sized material within the molten material using at least one dispersion technique selected from the group consisting of agitating the molten material using ultrasonic energy to disperse the nano-sized material within the molten material, introducing at least one active element into the molten material to enhance wetting of the nano-sized material by the molten material, and coating the nano-sized material with a wetting agent to promote wetting of the molten metal on the nano-sized material; and solidifying the molten material to form a solid nanocomposite material, the nanocomposite material comprising a dispersion of the nano-sized material within a solid matrix.

30 Claims, 2 Drawing Sheets

OTHER PUBLICATIONS

P.K. Rohatgi, R. Asthana, S. Das, "Solidification, structures and properties of cast metal–ceramic particle composites", International Metals Review, vol. 31, No. 3 (1986) pp. 115–139.

Y. Genma, Y. Tsunekawa, M. Okumiya, N. Mohri, "Incorporation of Alumina Particles with Different Shapes and Sizes inot Molten Aluminum Alloy by Melt Stirring with Ultrasonic Vibration", Materials Transactions, JIM, vol. 38, No. 3 (1997), pp. 232–239.

P. Busse, F. Deuerler, J. Potschke, "The stability of the ODS alloy CMSX6–Al2O3 during melting and solidification under low gravity", Journal of Crystal Growth 193 (1998), pp. 413–425.

A. M. Tissier and J. K. Tien, "Influence of Gravity on the Dispersoids during the Melting of an Oxide Dispersion–Strengthened Alloy (INCONEL MA754)", Metallurgical Transactions A, vol. 21A, Mar. (1990), pp. 753–755.

International Search Report dated Apr. 5, 2004.

* cited by examiner

METHOD FOR MAKING MATERIALS HAVING ARTIFICIALLY DISPERSED NANO-SIZE PHASES AND ARTICLES MADE THEREWITH

BACKGROUND OF INVENTION

This invention relates to composite materials having artificially dispersed nano-size phases. More particularly, this invention relates to methods for manufacturing such materials using solidification processing techniques. This invention also relates to articles made using such methods.

The term "composite material" as used herein generally refers to a class of materials comprising a combination two or more different materials, for example, tungsten carbide particles dispersed within a cobalt alloy. Composite materials often comprise a discontinuous or fibrous phase dispersed within a matrix phase. The functions served by the various phases are manifold and depend on the application for which the composite material is intended. For example, many composites designed for enhanced mechanical properties comprise a hard, strong discontinuous phase, such as, but not limited to, particles, dispersed within a more ductile matrix phase, such as a metal. The matrix phase serves to bind the particles to the material and to provide toughness and impact resistance, while the particles add hardness, wear resistance, and strength to the material. Typically, as the space between particles (referred to as the interparticle spacing) becomes closer, the resultant material becomes stronger. A dispersion of close particles restricts dislocation movement, and thus strengthens the material.

FIG. 1 is an exemplary graph of particle strengthening effects, showing an increase in the Orowan shear stress with a decrease in the interparticle spacing (IPS), in nanometers. This figure represents a generalized relationship of strength versus IPS, using Orowan stress T (MPa) that is calculated from the equation: $T=\{Gb\ \ln(D/b)\}/\{2\pi(T-D)\}$, where G is shear modulus, b is Burger's vector, D is the diameter of the particle, and T is the interparticle spacing.

Consistent with the mechanical strength example described above, materials with microstructural features such as grains or discontinuous phases with sizes on the order of about 100 nm and less have shown a wide variety of desirable properties. There is considerable interest in the class of materials known as "nanocomposites," composite materials that comprise a dispersion of at least one nano-scale discontinuous phase within a matrix phase. As used herein, the terms "nano-scale" and "nano-size" both refer to materials having an average size of about 100 nm or less in at least one dimension. The high percentage of atoms residing at interfaces within nanocomposite materials, along with the multitude of potential matrix/particle material combinations, creates the potential for unprecedented material properties and combinations of properties.

Several technological challenges are evident in the manufacture of nanocomposite materials. While solidification processing of metal-matrix composites is common in the art, the average size of the dispersed phase is generally well over 100 nm, and thus such composites cannot take advantage of the unique benefits offered by nano-scale materials, as exemplified by the effects documented in FIG. 1. There is a longfelt need in the materials industry for nanocomposites manufactured via solidification processing, due to the advantageous cost and flexibility offered by this type of processing. However, the behavior of materials becomes dramatically different as their size is reduced from the micron and sub-micron scales (that is, greater than 100 nm) to the nano-scale (that is, 100 nm or less), due in part to the much higher surface areas per unit of weight of nano-sized materials versus larger reinforcements. Production of nanocomposites has been shown not to be simply an adaptation of processes used to form composites having micron-sized and larger phase dispersions. Typical methods used in the art for dispersing micron-scale phases in molten matrix materials can result in the non-uniform distribution of nano-scale phases, due to the greater tendency of the nano-scale phases to agglomerate, float, sink and combinations thereof. Experimental work performed by A. M. Tissier and J. K. Tien (Metallurgical Transactions A, 21 A (March, 1990), pp. 753–755) demonstrates the agglomeration problem in detail and the difficulties posed by this phenomenon. Furthermore, other researchers (P. Busse et al., Journal of Crystal Growth, 193 (1998), pp. 413–425) have not only demonstrated the difficulties due to nano-size phase agglomeration, but have also speculated that, in general, it is not possible to maintain a stable homogeneous suspension of ceramic nano-scale phases in molten metal, thus rendering efforts to make single-crystal nanocomposite materials via solidification processing futile.

Composites produced by mechanical alloying and their associated formation processes are also known in the art. Mechanically alloyed particle-dispersion strengthened articles are made using powder metallurgy (PM) processes. The PM processes include, but are not limited to, hot isostatic-pressing (HIP) processes. PM processes have inherent size limitations in which PM production is limited to relatively small articles (those articles that have a diameter less than about 20 centimeters). PM processes are impractical for dispersion strengthening of large metal articles, such as large power generation equipment including rotors for steam turbines. In addition, PM processes result in materials that are significantly higher in cost compared to materials processed using solidification processes such as casting.

Therefore, there is a need to provide methods to efficiently and effectively manufacture nanocomposite materials in a cost-effective manner. Furthermore, there is a need to provide articles made from such technologically attractive and cost-effective materials.

SUMMARY OF INVENTION

Embodiments of the present invention address these and other needs. One embodiment is a method for forming a nanocomposite material. The method comprises providing a molten material; providing a nano-sized material, the nano-sized material being substantially inert with respect to the molten material; introducing the nano-sized material into the molten material; dispersing the nano-sized material within the molten material using at least one dispersion technique selected from the group consisting of agitating the molten material using ultrasonic energy to disperse the nano-sized material within the molten material; introducing at least one active element into the molten material to enhance wetting of the nano-sized material by the molten material; and coating the nano-sized material with a wetting agent to promote wetting of the molten metal on the nano-sized material; and solidifying the molten material to form a solid nanocomposite material, the nanocomposite material comprising a dispersion of the nano-sized material within a solid matrix.

A second embodiment of the present invention is an article manufactured by the method of the present invention.

A third embodiment an article comprising a nanocomposite material, wherein the nanocomposite material comprises a matrix having a microstructure selected from the group consisting of a directionally solidified microstructure and a single crystal microstructure, and a dispersion of nano-sized material within the matrix.

A fourth embodiment is an article comprising a nanocomposite material, the nanocomposite material comprising a dispersion of nano-sized material. The dispersion has a size distribution having a size range (i.e., the difference between the maximum particle size and the minimum particle size) less than about 20% of the mean particle size of the distribution.

A fifth embodiment is an article comprising a nanocomposite material. The nanocomposite material comprises a dispersion of nano-sized material within a solidified matrix material. The dispersion of nano-sized material has an average particle size of up to about 100 nm, and an interparticle spacing of up to about 100 nm.

BRIEF DESCRIPTION OF DRAWING

These and other features, aspects, and advantages of the present invention will become better understood when the following detailed description is read with reference to the accompanying drawings in which like characters represent like parts throughout the drawings, wherein.

DETAILED DESCRIPTION

Figure 1:
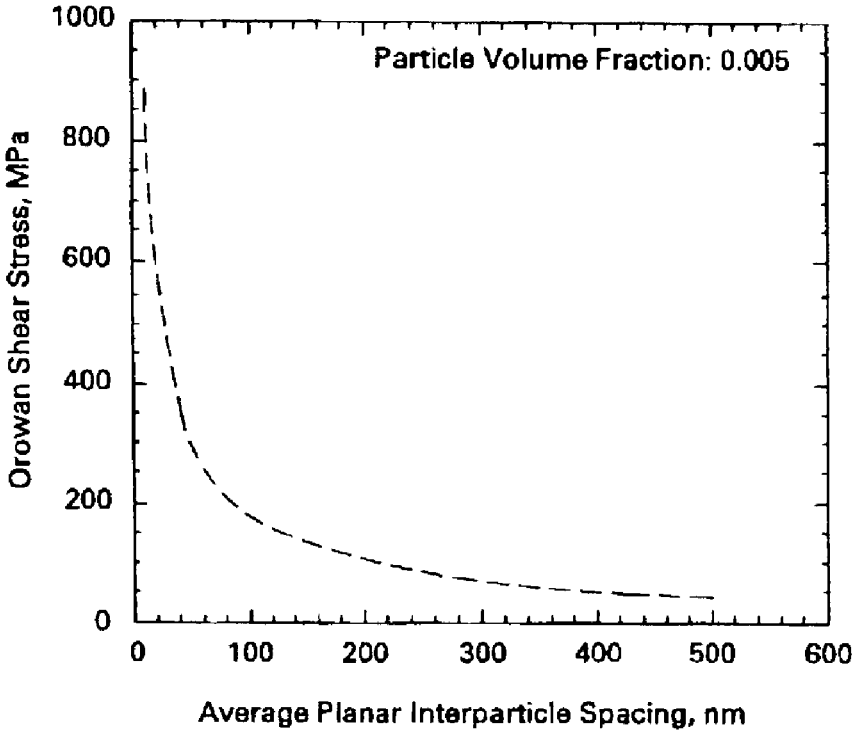
FIG. 1 is a graph depicting the relationship between Orowan shear stress and the average interparticle spacing.

Embodiments of the present invention include a method for making a nanocomposite material. As used in the description of embodiments of the present invention and the corresponding claims, the term "nanocomposite material" refers to a material comprising at least one artificially dispersed nano-sized phase within a matrix material. "Artificially dispersed" as used herein means that the dispersion is created by physically adding at least one nano-size material to the matrix material and dispersing at least one nano-size material throughout the matrix, as opposed to relying on a "natural" phenomenon, such as, for example, in-situ chemical reaction or phase precipitation, to create a dispersion for each nano-size material in the nanocomposite. The matrix material may comprise a single phase or a plurality of phases, as described in more detail herein.

In order to provide a relatively low-cost method for the manufacture of nanocomposite materials relative to powder metallurgy processes, while at the same time enabling the formation of large metal articles, such as large power generation equipment, embodiments of the present invention include a method comprising introducing a nano-sized material, such as nano-sized particles, into molten material. The nano-sized material is dispersed within the molten material using at least one of several dispersion techniques described herein, and the molten material is solidified to form a nanocomposite material. This "solidification processing" technique lends itself to the formation of large, complex parts that, if processed according to conventional PM methods, would be prohibitively expensive.

A molten material, such as, for example, molten metal, is provided. The molten material comprises any material having properties deemed suitable for an intended application; examples of such materials include, but are not limited to, an alloy comprising multiple chemical elements. In certain embodiments, the molten material comprises at least one metal selected from the group consisting of iron, copper, aluminum, nickel, molybdenum, titanium, tin, and mixtures thereof.

Nano-sized material (material with an average size of about 100 nm or less in at least one dimension) is provided and introduced into the molten material. Nano-sized materials may be produced by any appropriate process, including, but not limited to, chemical-mechanical processing, spray drying, sol-gel processing, gas phase condensation, and powder manufacturing. The nano-sized material is substantially inert with respect to the molten material, meaning that the bulk of the nano-sized material does not physically or chemically react with the molten material to a degree that significantly alters the properties of the bulk inert material. Surface modification of the nano-sized material during contact with the molten material is possible and in some instances encouraged, such as, for example, in the use of active elements to enhance wetting.

Nano-sized materials, as used in embodiments of the present invention, include, but are not limited to, ceramics, intermetallics, and metals. Other examples of nano-sized materials according to embodiments of the present invention include coated and encapsulated materials. Ceramic materials and intermetallics are often used to enhance, for example, the high-temperature mechanical strength of the nanocomposite material. In some embodiments the ceramic comprises an oxide, such as, for example, an oxide comprising at least one of aluminum, yttrium, zirconium, and cerium. In other embodiments, the ceramic comprises at least one of a carbide, a nitride, and a boride. In still other embodiments, the intermetallic comprises a silicide. In certain embodiments where the nano-sized material comprises a metal, the nano-sized metal has a melting temperature higher than that of the molten material such that the nano-sized metal remains substantially inert with respect to the molten metal. Metals with high melting points, for example, tungsten, are suitable as nano-sized materials for embodiments of this type. It will be appreciated by those skilled in the art that the choice of any specific combination of molten material and nano-sized material is based upon the combination of properties desired for the resultant nanocomposite material, including, but not limited to, physical, chemical, mechanical, electrical, magnetic, and thermal properties.

The nano-sized material, according to embodiments of the present invention, comprises material wherein at least about 50 percent by volume of the nano-sized material has a length in at least one dimension of less than about 100 nm. In particular embodiments, at least about 50 percent by volume of the nano-sized material has a length in at least one dimension of less than about 30 nm. Several nano-sized material morphologies are suitable for use in embodiments of the present invention, depending upon the specific properties desired. In some embodiments, the nano-sized material comprises at least one of spheres, rectangular prisms, cubes, rods, tubes, and plates; irregular shapes are also suitable for use in certain embodiments of the present invention. Spheres in which at least a portion of the spheres is hollow are employed in certain embodiments to achieve certain desirable features in the finished nanocomposite material, such as, for example, to reduce the density of the composite, or to increase the ability of the composite to dampen vibrations.

The nano-sized material can be introduced to the molten material by any appropriate process. For example, and in no way limiting of the invention, the nano-sized material can be injected under a top surface of the molten material. Alternatively, the nano-sized material can be added to the molten material on the top surface and mixed into the molten material. A further alternative is introducing a master alloy comprising an enhanced concentration of nano-sized material into the molten material as described in U.S. Pat. No. 6,251,159 to Angeliu et al. The nano-sized material is introduced at an appropriate concentration level within the molten material to impart desired properties to the final nanocomposite material. Embodiments in which the nano-sized material is introduced into the molten material in an amount of up to about 40 volume percent may be useful for certain applications in which, for example, wear resistance is desirable. In other embodiments, nano-sized material is introduced into the molten material in an amount of up to about 5 volume percent; such embodiments may be useful for certain applications in which, for example, mechanical properties such as creep rupture strength with suitable ductility are desired.

Figure 2:
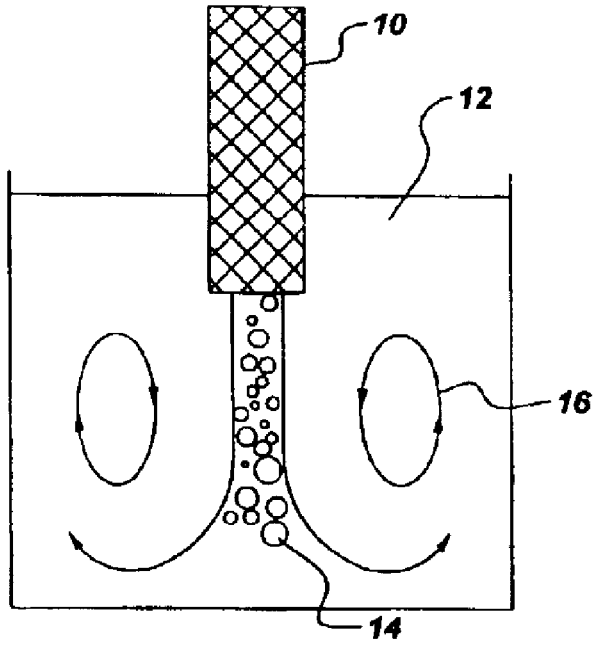
FIG. 2 is a schematic representation of an exemplary embodiment wherein ultrasonic energy is used to agitate molten material.
Figure 3:
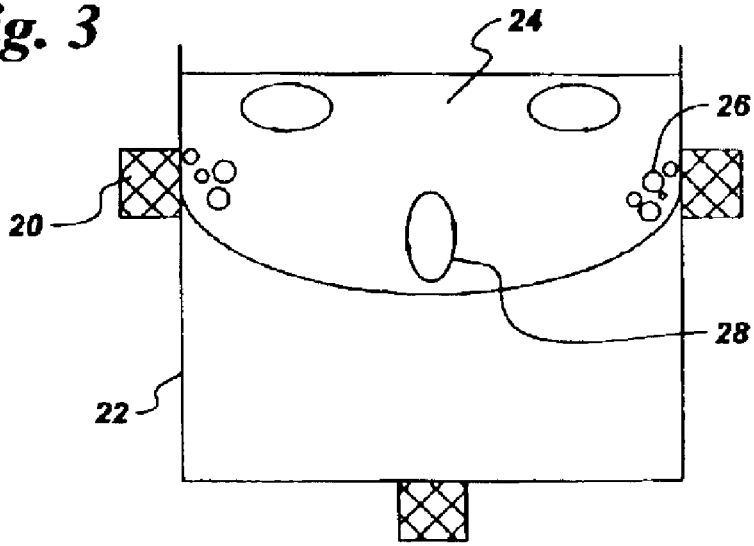
FIG. 3 is a schematic representation of another exemplary embodiment employing ultrasonic agitation.

The nano-sized material is dispersed within the molten material using at least one of several dispersion techniques. One technique is agitating the molten material using ultrasonic energy to disperse the nano-sized material within the molten material. Any of a variety of methods for impinging ultrasonic energy on the molten material is suitable for use in embodiments of the present invention. FIG. 2 illustrates an exemplary arrangement in which an ultrasonic transmitting device 10 is submersed within the molten material 12 to produce cavitation 14 and acoustic streaming 16 within molten material. FIG. 3 illustrates an alternative arrangement in which ultrasonic transducers 20 are arrayed outside of, and coupled with, a crucible or mold 22 containing molten material 24, producing cavitation 26 and acoustic streaming within molten material 24. Ultrasonic energy offers advantages over more traditional methods for achieving a dispersion of nano-sized material within a molten material such as stirring, electromagnetic mixing, forced gas mixing, and physical mixing devices, in that the formation of acoustic streamlines and cavitation bubbles create sufficient force in a uniformly distributed manner within the molten material to enable the formation of a uniform dispersion of nano-sized material throughout the molten material. The desired set points for processing parameters used for ultrasonically agitating molten material depend upon the quantity and identity of the molten material in use. The desired effect of the ultrasonic energy is uniform agitation within the molten material by the nucleation and collapse of cavitation bubbles and the formation of acoustic streamlines, which effect is influenced by such parameters as frequency and power of the ultrasonic energy. In certain embodiments, the ultrasonic energy used in the method of the present invention has a frequency in the range from about 10 kHz to about 40 kHz, such as from about 20 kHz to about 30 kHz. A second dispersion technique suitable for use in embodiments of the present invention is introducing at least one active element into the molten material to enhance wetting of the nano-sized material by the molten material. As used herein, the term "active elements" refers to elements that act to lower the interfacial energy at the interface between the molten material and the nano-sized material; this effect enables molten material comprising active elements to "wet," that is, to develop intimate contact with, the nano-sized oxide material. By developing intimate wetting contact between the molten material and the nano-sized materials, this embodiment of the method of the present invention promotes stronger bonding between the matrix and the nano-sized material upon solidification. Promotion of wetting the nano-sized material by the molten material may also promote uniform dispersion of the nano-sized material within the molten material by creating a barrier of molten material between individual units of nano-sized material, reducing the agglomeration of nano-sized materials within the molten material and thereby enhancing the ability to form a nanocomposite material with a desirably uniform dispersion of nano-sized materials. In certain embodiments, the at least one active element is selected from the group consisting of titanium, zirconium, yttrium, magnesium, hafnium, oxygen, sulfur, and mixtures thereof. In some embodiments, introducing the at least one active element comprises introducing at least 0.01 weight percent of the active element into said molten material. A third dispersion technique suitable for use in embodiments of the present invention is coating the nano-sized material with a wetting agent to promote wetting of the molten metal on the nano-sized material. The advantages of promoting wetting have been described above. Any of a variety of coating techniques is suitable for providing the coating on the nano-sized material, including, but not limited to, chemical vapor deposition, physical vapor deposition, sol-gel processing, electrochemical techniques, and the like. In certain embodiments, coating the nano-sized material with a wetting agent comprises coating the nano-sized material with a coating material comprising one of titanium, zirconium, yttrium, magnesium, hafnium, and mixtures thereof. The coating material may comprise one of a ceramic, for example, an oxide; an intermetallic, for example, a silicide; and a metal, for example, an alloy comprising any of the elements discussed above for use as a wetting agent. In certain embodiments, coating the nano-sized material comprises coating the nano-sized material with a layer having a thickness of at least a single molecular diameter thick, also known in the art as a "monolayer." The molten material is solidified to form a solid nanocomposite material comprising a dispersion of the nano-sized material within a solid matrix. The use of one or more of the dispersion technologies described above may enable a stable, homogeneous dispersion of nano-sized material to be maintained within the molten material, even when advanced solidification technologies such as, for example, directional solidification and single crystal processing are employed, and thus, in some embodiments, solidifying the molten material comprises one of a. directionally solidifying to form a directionally solidified solid matrix, and b. forming a single crystal solid matrix. The use of techniques such as directional solidification (DS) and single crystal (SX) processing enhances the high temperature strength of the solid matrix, and consequently that of the nanocomposite material as a whole. The capability of using DS and SX techniques to form nanocomposite materials with enhanced high temperature properties is a potential advantage of the solidification processing method of the present invention with respect to conventional powder metallurgy methods. Accordingly, embodiments of the present invention include an article comprising a nanocomposite material, wherein the nanocomposite material comprises a matrix having a microstructure selected from the group consisting of a directionally solidified microstructure and a single crystal microstructure, and a dispersion of nano-sized material within the matrix. The characteristics of the nano-sized material and the matrix discussed herein in accordance with the method embodiments of the present invention also apply to the article embodiments described above and hereinafter.

The solidified composite microstructure may consist of any combination of microstructural features, depending on the processing and chemistry used to create the material. For example, naturally occurring phases, such as precipitates, may be present in the nanocomposite in addition to the nano-sized material. Artificial dispersion phases, such as micron-sized dispersoids commonly used in metal matrix composites, may also be present in the material. Such combinations may allow for synergistic behavior among the various phases of varying length scales to provide a wide variety of useful property combinations.

Upon solidification, the dispersion of the nano-sized material within the solid matrix has an interparticle spacing (IPS). In some embodiments, the average IPS is less than about 100 nm. In certain embodiments, the average IPS is in the range from about 1 nm to about 100 nm, while in particular embodiments, the average IPS is in the range from about 1 nm to about 50 nm. As several properties, such as mechanical strength, depend upon the IPS of the dispersion, the processing of the molten material and the nano-sized material is manipulated as provided by embodiments of the present invention to achieve an average IPS that achieves properties desired for a particular application.

Because the nano-sized material is added to molten material, dispersed, and the molten material is solidified, the nano-sized material is not subjected to any mechanical processes which would significantly alter the size distribution or morphology of the nano-sized material between the time it is added to the molten material and the time the molten material is solidified. This is in stark contrast to conventional powder metallurgy methods, in which a significant amount of ball milling is used to mix the matrix with any additives. The ball milling process often breaks up the additive material during processing, and thus there is often a significant difference between the size distribution and morphology of the additive material prior to addition to the matrix material and that of the same material as present in the composite. Therefore, one particular advantage of the method of the present invention is the ability to precisely control the size distribution and morphology of the nano-sized material contained within the solidified nanocomposite, which may offer advantages in controlling the nanocomposite properties. Accordingly, embodiments of the present invention include an article comprising a nanocomposite material, the nanocomposite material comprising a dispersion of nano-sized material. The dispersion has a size distribution having a size range (i.e., the difference between the maximum particle size and the minimum particle size) less than about 20% of the mean particle size of the distribution. For example, where the mean particle size is 20 nm, the difference between the minimum particle size and the maximum particle size is less than 4 nm. In some embodiments, the size range is less than about 10% of the mean particle size. Although the ability to precisely control the size distribution of the nano-sized material allows for the creation of materials with narrowly controlled dispersions, as described above, the embodiments of the present invention are also applicable to cases where much broader size distributions, including distributions with multiple modes (e.g., bimodal and tri-modal distributions) are desired.

To further exploit the advantages described for the various embodiments, above, certain embodiments of the present invention include methods according to the above description, in which various combinations of dispersion techniques are employed. For example, in some embodiments, the dispersing step comprises agitating with ultrasonic energy and introducing at least one active element selected from the group consisting of titanium, zirconium, yttrium, magnesium, hafnium, oxygen, sulfur, and mixtures thereof. In other embodiments, dispersing comprises agitating using ultrasonic energy and coating the nano-sized material with a wetting agent comprising one of titanium, zirconium, yttrium, magnesium, hafnium, and mixtures thereof. In further embodiments, dispersing comprises all three steps of agitating with ultrasonic energy, introducing at least one active element into the molten material, and coating the nano-sized material with a wetting agent as described above.

A further embodiment of the present invention is an article made by the method of the present invention, as described above, and further comprising the step of forming the nanocomposite material into the article. The step of forming is accomplished using any of a variety of suitable techniques. For example, the steps of solidifying and forming may be accomplished simultaneously for embodiments in which the article is cast. In other embodiments, forming is accomplished after solidification using such techniques as forging, extruding, and the like.

Embodiments of the present invention also include an article comprising a nanocomposite material. The nanocomposite material comprises a dispersion of nano-sized material within a solidified matrix material. As used herein, the term "solidified" means processed directly from a molten material to form a continuous solid material, such as is done, for example, in a casting process. The nano-sized material has an average particle size of up to about 100 nm, and an interparticle spacing of up to about 100 nm. The characteristics of the nano-sized material and the matrix discussed previously in accordance with the method embodiments of the present invention also apply to this and the other article embodiments described herein.

The method and articles of the present invention are applicable to a wide variety of combinations of matrix material/nano-sized material combinations. The following examples are set forth to further describe possible embodiments, and should not be construed as limiting the invention in any way.

EXAMPLE 1

A stainless steel composition comprising iron and chromium is melted, and up to 5 volume percent of coated nano-sized (average length of about 100 nm or less in at least one dimension) yttria powder in accordance with the embodiments of the present invention is added to the melt. The yttria is coated with a wetting agent comprising nickel, and the melt further comprises at least 0.01 weight percent of yttrium as an active element. The melt, containing the nano-sized yttria, is agitated using high-intensity ultrasonic energy in accordance with the above description, and then the melt is solidified in a mold to form an article comprising a stainless steel-yttria nanocomposite. The article is a cast component for use in power-generation equipment.

EXAMPLE 2

An article comprising a nanocomposite material is made according to embodiments of the present invention. The article suitable for use as, for example, an engine block for an automobile, and the nanocomposite material comprises an aluminum alloy and a dispersion of aluminum oxide (alumina) particles having an average size of about 100 nm or less in at least one dimension, and an average interparticle spacing of less than about 100 nm. The dispersion has size range that is less than about 10% of the mean particle size. The nanocomposite material has an interparticle spacing in accordance with embodiments of the present invention.

While various embodiments are described herein, it will be appreciated from the specification that various combinations of elements, variations, equivalents, or improvements therein may be made by those skilled in the art, and are still within the scope of the invention as defined in the appended claims.

What is claimed is:

1. A method for forming a nanocomposite material, the method comprising:

providing a molten material;

providing a nano-sized material, said nano-sized material being substantially inert with respect to said molten material;

introducing said nano-sized material into said molten material;

dispersing said nano-sized material within said molten material by agitating said molten material using ultrasonic energy to disperse said nano-sized material within said molten material; and solidifying said molten material to form a solid nanocomposite material, said nanocomposite material comprising a dispersion of said nano-sized material within a solid matrix.

2. The method of claim 1, wherein providing said molten material comprises providing at least one metal selected from the group consisting of iron, copper, aluminum, nickel, molybdenum, titanium, tin, and mixtures thereof.

3. The method of claim 1, wherein providing said nano-sized material comprises providing at least one of a ceramic, an intermetallic, and a metal.

4. The method of claim 3, wherein providing said ceramic comprises providing an oxide.

5. The method of claim 4, wherein said oxide comprises at least one of aluminum, yttrium, zirconium, and cerium.

6. The method of claim 3, wherein providing said ceramic comprises providing at least one of a carbide, a nitride, and a boride.

7. The method of claim 3, wherein providing said intermetallic comprises providing an intermetallic comprising a silicide.

8. The method of claim 3, wherein providing a metal comprises providing a metal comprising tungsten.

9. The method of claim 1, wherein providing said nano-sized material comprises providing a nano-sized material wherein at least about 50 percent by volume of said nano-sized material has a length in at least one dimension of less than about 100 nm.

10. The method of claim 9, wherein said length in said at least one dimension is less than about 30 nm.

11. The method of claim 1, wherein providing said nano-sized material comprises providing material comprising at least one of spheres, rectangular prisms, cubes, rods, tubes, and plates.

12. The method of claim 11, wherein at least a portion of said spheres is hollow.

13. The method of claim 1, wherein agitating said molten material using ultrasonic energy comprises using ultrasonic energy having a frequency in the range from about 10 kHz to about 40 kHz.

14. The method of claim 13, wherein said frequency is in the range between about 20 kHz and about 30 kHz.

15. The method of claim 1, wherein said dispersion of said nano-sized particles comprises an average inter-particle spacing of less than about 100 nm.

16. The method of claim 15, wherein said average inter-particle spacing is in the range from about 1 nm to about 100 nm.

17. The method of claim 16, wherein said average inter-particle spacing is in the range from about 1 nm to about 50 nm.

18. The method of claim 1, wherein solidifying said molten material comprises one of directionally solidifying to form a directionally solidified solid matrix; and forming a single crystal solid matrix.

19. The method of claim 1, wherein introducing said nano-sized material comprises introducing said nano-sized material in an amount of up to about 40 volume percent into said molten material.

20. The method of claim 19, wherein introducing said nano-sized material comprises introducing said nano-sized material in an amount of up to about 5 volume percent into said molten material.

21. The method of claim 1, wherein providing said molten material comprises introducing at least one active element into said molten material to enhance wetting of said nano-sized material by said molten material.

22. The method of claim 21, wherein introducing said at least one active element comprises introducing a material selected from the group consisting of titanium, zirconium, yttrium, magnesium, hafnium, oxygen, sulfur, and mixtures thereof.

23. The method of claim 21, wherein introducing said at least one active element comprises introducing at least 0.01 weight percent of said active element into said molten material.

24. The method of claim 1, wherein providing said nano-sized material comprises coating said nano-sized material with a wetting agent to promote wetting of said molten metal on said nano-sized material.

25. The method of claim 24, wherein coating said nano-sized material with a wetting agent comprises coating said nano-sized material with a coating material with a wetting agent comprises coating said nano-sized material with a coating material comprising one of titanium, zirconium, yttrium, magnesium, hafnium, and mixtures thereof.

26. The method of claim 25, wherein said coating material comprises one of a ceramic, an intermetallic, and a metal.

27. The method of claim 24, wherein coating said nano-sized material comprises coating said nano-sized material with a layer having a thickness of at least a monolayer of said wetting agent.

28. A method for forming a nanocomposite material, the method comprising:

providing a molten material;

providing a nano-sized material, said nano-sized material being substantially inert with respect to said molten material;

introducing said nano-sized material into said molten material;

dispersing said nano-sized material within said molten material, wherein dispersing comprises the steps of a. agitating said molten material using ultrasonic energy to disperse said nano-sized material within said molten material, and b. introducing into said molten material at least one active element selected from the group consisting of titanium, zirconium, yttrium, magnesium, hafnium, oxygen, sulfur, and mixtures thereof, to enhance wetting of said nano-sized material by said molten material; and solidifying said molten material to form a solid nanocomposite material, said nanocomposite material comprising a dispersion of said nano-sized material within a solid matrix, said dispersion comprising an average inter-particle spacing of less than about 100 nm.

29. A method for forming a nanocomposite material, the method comprising:

providing a molten material;

providing a nano-sized material, said nano-sized material being substantially inert with respect to said molten material;

introducing said nano-sized material into said molten material;

dispersing said nano-sized material within said molten material, wherein dispersing comprises the steps of a. agitating said molten material using ultrasonic energy to disperse said nano-sized material within said molten material, b. coating said nano-sized material with a wetting agent comprising one of titanium, zirconium, yttrium, magnesium, hafnium, and mixtures thereof, to promote wetting of said molten metal on said nano-sized material; and solidifying said molten material to form a solid nanocomposite material, said nanocomposite material comprising a dispersion of said nano-sized material within a solid matrix, said dispersion comprising an average inter-particle spacing of less than about 100 nm.

30. A method for forming a nanocomposite material, the method comprising:

providing a molten material;

providing a nano-sized material, said nano-sized material being substantially inert with respect to said molten material;

introducing said nano-sized material into said molten material;

dispersing said nano-sized material within said molten material, wherein dispersing comprises the steps of a. agitating said molten material using ultrasonic energy to disperse said nano-sized material within said molten material, b. introducing into said molten material at least one active element selected from the group consisting of titanium, zirconium, yttrium, magnesium, hafnium, oxygen, sulfur, and mixtures thereof, to enhance wetting of said nano-sized material by said molten material, and c. coating said nano-sized material with a wetting agent comprising one of titanium, zirconium, yttrium, magnesium, hafnium, and mixtures thereof, to promote wetting of said molten metal on said nano-sized material; and solidifying said molten material to form a solid nanocomposite material, said nanocomposite material comprising a dispersion of said nano-sized material within a solid matrix, said dispersion comprising an average inter-particle spacing of less than about 100 nm.

* * * * *